United States Patent [19]

Titchenal

[11] Patent Number: 4,569,083

[45] Date of Patent: Feb. 4, 1986

[54] CHAIN OF OPEN MOUTH BAGS

[75] Inventor: Oliver R. Titchenal, North Ridgeville, Ohio

[73] Assignee: Basic Packaging Systems, Inc., Avon Lake, Ohio

[21] Appl. No.: 578,019

[22] Filed: Feb. 8, 1984

[51] Int. Cl.[4] ..... B65D 33/16; B65D 33/22

[52] U.S. Cl. ..... 383/37; 383/78; 383/89

[58] Field of Search ..... 383/37, 78, 82, 89

[56] References Cited

U.S. PATENT DOCUMENTS

| | | | |
|---|---|---|---|
| 2,527,074 | 10/1950 | Port | 229/62 |
| 2,647,680 | 8/1953 | Vogt | 229/53 |
| 2,757,855 | 8/1956 | Allen | 229/62 |
| 3,163,352 | 12/1964 | Fesco | 229/62 |
| 3,473,725 | 10/1969 | Wiehahn | 229/62 |
| 3,559,874 | 2/1971 | Titchenal | 229/69 |
| 3,650,460 | 3/1972 | Lokey | 229/62 |
| 3,791,573 | 2/1974 | Titchenal | 229/69 |
| 3,817,017 | 6/1974 | Titchenal | 53/24 |

*Primary Examiner*—Stephen P. Garbe

*Attorney, Agent, or Firm*—Pearne, Gordon, Sessions, McCoy, Granger & Tilberry

[57] ABSTRACT

A continuous strip covering the open mouth end of bags connects successive bags in a chain of bags. The strip is activatable relative to the bags to constitute adhesive for sealing the bags when they are filled and closed.

16 Claims, 9 Drawing Figures

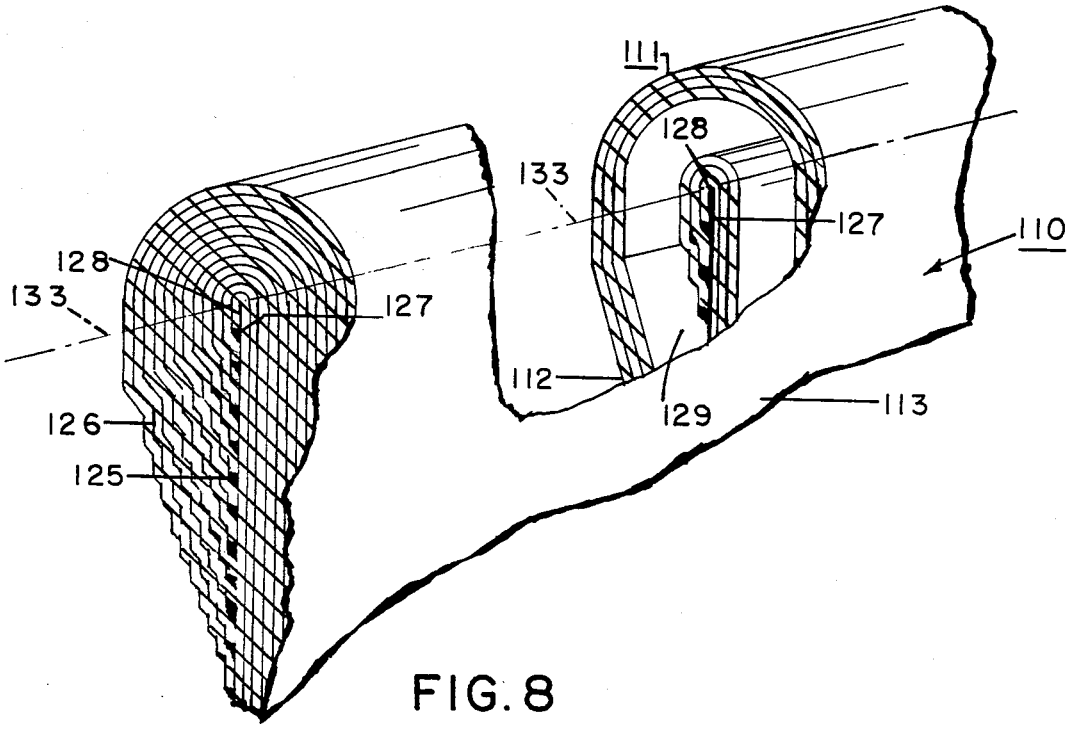
FIG. 8
FIG. 9
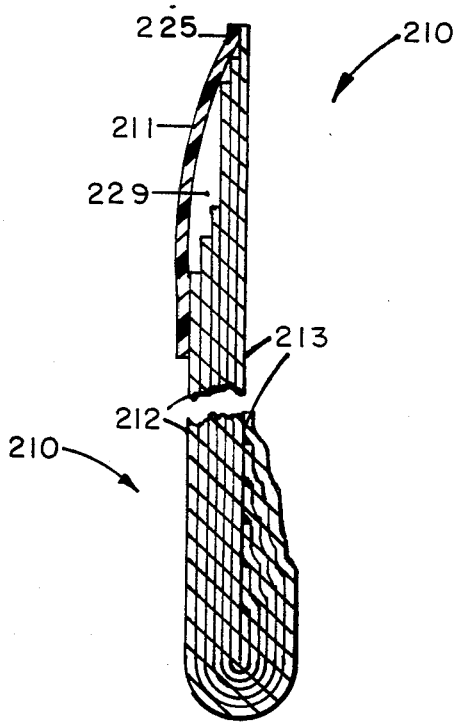

CHAIN OF OPEN MOUTH BAGS

This is a continuation of application Ser. No. 343,723, filed Jan. 29, 1982.

BACKGROUND OF THE INVENTION

FIELD TO WHICH INVENTION RELATES

This invention relates to a chain of open mouth bags interconnected along the open mouths thereof by an elongated continuous strip having one edge thereof united to the back wall of each successive bag and the other edge thereof united to the front wall and thereby forming a tunnel over the open mouths of the bags. The strip is made of material such that it will adhesively and sealably unite the back wall to the front wall for closingly sealing the bag after it has been filled.

DESCRIPTION OF THE PRIOR ART

Chains of open mouth bags have been manufactured in the past. A tube of film was converted to a chain of successive bags by heat sealing opposite sides of the tube to itself as more fully described in prior patents issued to Oliver R. Titchenal, namely, U.S. Pat. No. 3,559,874, issued Feb. 2, 1971 and U.S. Pat. No. 3,791,573, issued Feb. 12, 1974 and U.S. Pat. No. 3,817,017, issued June 18, 1974. In FIGS. 26 to 31 of U.S. Pat. No. 3,559,874 and FIGS. 5 to 8 of U.S. Pat. No. 3,791,573 there are illustrated open mouth bags interconnected into chains of bags by an inverted U-shaped strip.

STATEMENT OF THE INVENTION

The present invention relates to a chain of open mouth bags and to a bag which has a new and novel improvement over the prior art.

One of the objects of the invention is to provide a chain of open mouth bags in which the elongated strip uniting the bags along the top open mouth end thereof is activatable and ultimately becomes the adhesive uniting the back wall to the front wall of the bag to close and seal it.

Another object of the present invention is to provide a chain of open mouth bags wherein the bags are made of paper or the like and are connected by an elongated strip of adhesive material which ultimately provides the adhesive for closing and sealing the end of the bag after it has been filled.

Still another object of the invention is to provide a chain of gusseted multi-wall open mouth bags ready for filling and then closing by folding the back wall over and adhering it to the front wall, and also the resultant bag formed therefrom.

Further objects and advantages may be observed from the following description of the invention in conjunction with the several drawings.

BRIEF DESCRIPTION OF THE DRAWINGS

FIG. 8 is an enlarged perspective view partly in section of a bag of FIG. 5 closed and sealed by adhering the back to the front wall thereof; and FIG. 9 is a sectional view of another modification of the invention.

DESCRIPTION OF THE PREFERRED EMBODIMENTS

Figure 1:
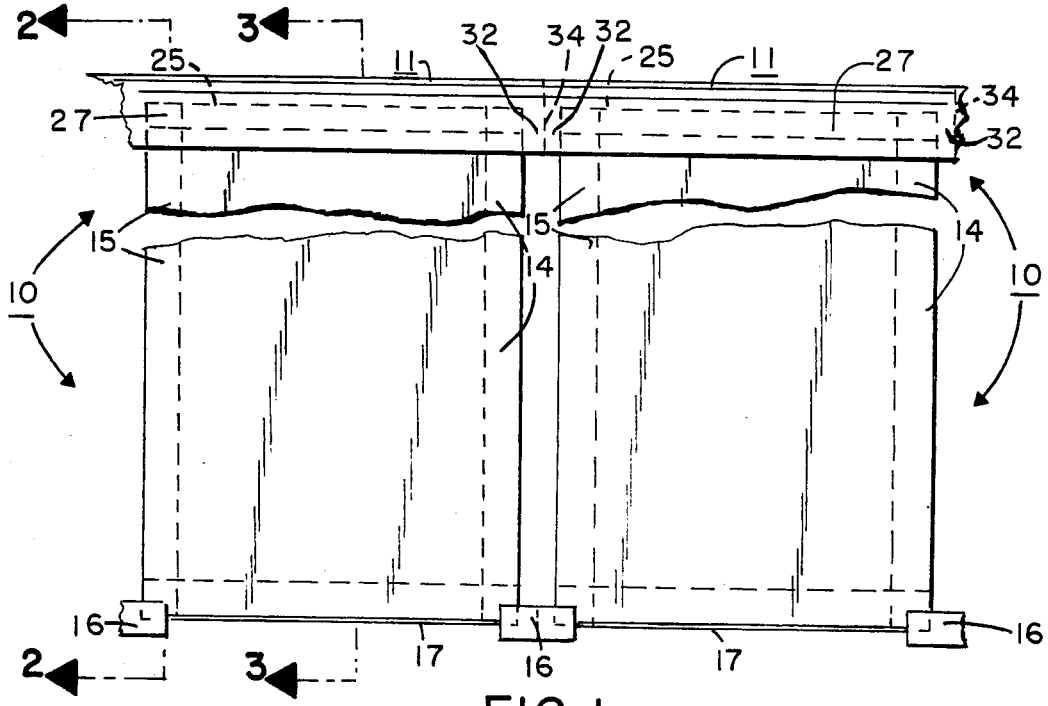
FIG. 1 is a plan view of a chain of open mouth bags.

A preferred embodiment of the invention is illustrated as a chain of open mouth bags 10 in FIG. 1. This chain of open mouth bags comprises individual bags 10 interconnected by an elongated continuous strip 11. Each bag 10 may be constructed by any well known method and may be made from any of the well known bag materials such for example polyethylene, polypropylene, other plastic materials, paper, jute, burlap, canvas, or any other material commonly used in the industry for the manufacture of bags. Each bag may have several plies, which may all be of the same material or they may be of different materials. The strip 11 is of activatable material such that it will adhesively and sealably unite with the material of the bag 10 and also be of sufficient mechanical strength to hold bags 10 successively in a chain of bags. Preferably the strip 11 is of a hot melt or other thermoplastic material, but it is understood that it may be made from other materials such as, for example, scrim and other woven or non-woven fiber reinforced materials which may be activated by moisture, radio frequency, temperature, heat or other activating means.

In addition the invention includes those designs wherein the material in the bag wall is activatable and the strip is of material providing mechanical and uniting strength, for example when the wall of the bag is thermoplastic material and the strip is scrim or paper or the like, the activating of the wall will cause it and the strip to sealably unite to close the bag.

Such scrim or fiber may be of or include a string of sufficient mechanical strength greater than that of the bag wall to constitute a tear string for opening the bag.

It is understood that the bag 10 may be of a gusseted or a non-gusseted type and of a single ply or a multi-ply construction. In the preferred embodiment, the bag 10 is illustrated as being a multi-ply side gusseted bag. The bag 10 is illustrated as having a front wall 12, a back wall 13, a fore gusset 14, and an aft gusset 15 with the fore and aft gussets 14 and 15 forming the side walls of the bag. In the chain of bags, the aft gusset 15 of one bag is next adjacent the fore gusset 14 of the next succeeding bag and is spaced therefrom a preselected distance but held in alignment therewith by strip 11 and if necessary, also by a bridge patch 16 interconnecting the bottom ends 17 of the bag.

Each bag illustrated in FIG. 1 has its bottom end 17 preclosed and sealed during manufacture thereof. It is understood that in most instances the opposite ends of the bag walls and gussets are cut in reverse but otherwise identical to each other and that therefore, if desired the bottom ends 17 may be left open and connected by a strip similar to strip 11 and omitting the patches. When strips are put at each end of the bag, rather than preclosing the bottom end, both ends could be closed and sealed at the time of filling the bag.

Figure 2:
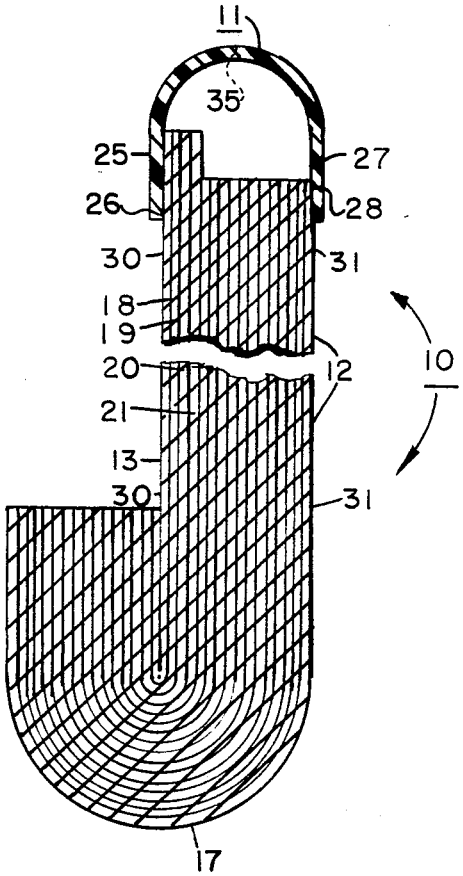
FIGS. 2 and 3 are enlarged sectional views along the lines 2—2 and 3—3 respectively of FIG. 1.
Figure 3:
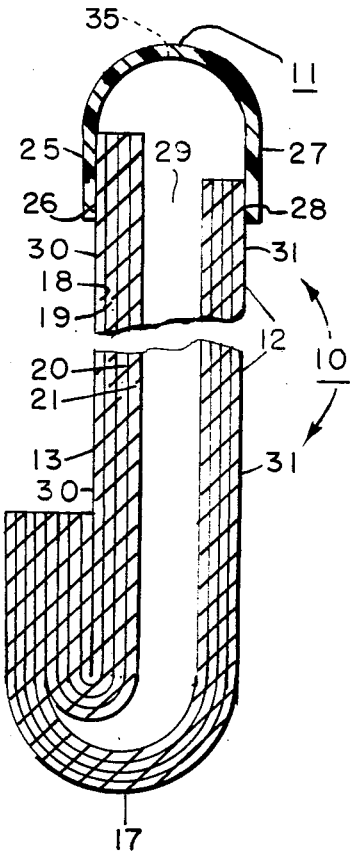

In the illustration in the FIGS. 2 and 3, the front wall 12 and the back wall 13, as well as the gussets, are formed from several plies 18, 19, 20, and 21 of bag material. In the drawings, for clarity, the thickness of the plies is exaggerated relative to the length; however, this distorts the proportions when the bag is folded over. The bag 10 is an open mouth bag having its back wall 13 extending above the front wall 12 at the top end thereof, and having its front wall 12 folded over and adhered to its back wall 13 at the bottom end 17 thereof.

The strip 11 is united along one edge 25 thereof to the top edge 26 of the back wall 13 of each successive bag 10 in the chain of bags. The strip 11 is united along the other edge 27 thereof to the top edge 28 of the front wall 12 of each successive bag 10 in the chain of bags. The strip 11 is of inverted U-shape, elongated, and continuous such that it covers the open mouth 29 of all bags 10 in the chain at the top ends thereof. The strip 11 may be of any preselected width so as to provide a tunnel of sufficient cross dimension interconnecting the top ends of the bags in the chain of bags. The strip 11 may also have one edge thereof made of one material and the other edge thereof made of another material to provide the desired strength and uniting of the walls of the bag into a sealed enclosure. In the embodiment in FIGS. 1, 2, and 3, the one edge 25 of strip 11 is united to the outer surface 30 of the back wall 13. Also, the other edge 27 of strip 11 is united to the outer surface 31 of the front wall 12. The one edge 25 and the other edge 27 of strip 11 may be united directly to each other as at areas 32 in the space between the fore gusset 14 and aft gusset 15 and thus between the bags 10 next adjacent each other in the chain to hold the gussets closed or in collapsed condition.

The strip 11 and patches 17 may be perforated, cut, or otherwise weakened at line 34 between the bags and between adjacent areas 32 so that one bag may easily be separated from the next adjacent bag in the chain. Also strip 11 may be provided with a longitudinal line of weakness as at 35 to assist in longitudinal slitting thereof for gaining access to the mouth of the bag. This line of weakness 35 may be in the form of perforations so the strip can be torn apart rather than cut during the filling and closing of the bag.

The strip 11 may be slit longitudinally along the center thereof if desired during filling of the bags. Because the single strip 11 is slit longitudinally to become two strips, it or they may sometimes be termed strip means. This uniting of the edges 25 and 27 of strip 11 at areas 32 also helps align the front wall and back wall of the bag for closing and sealing of the bag after the bag has been filled through its open mouth 29.

Figure 4:
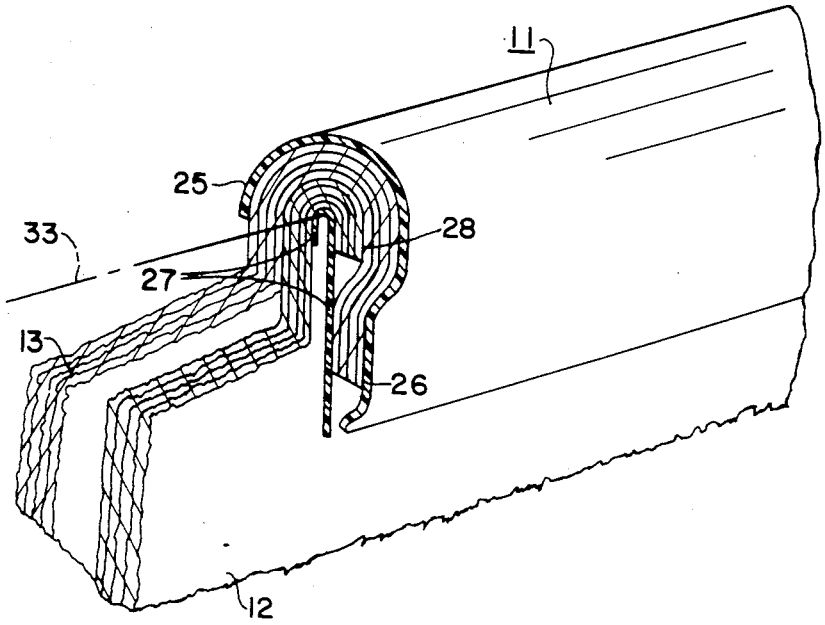
FIG. 4 is a perspective view partly in section showing a bag of FIG. 1 closed and sealed by folding the back wall over the front wall and adhering it thereto.
Figure 5:
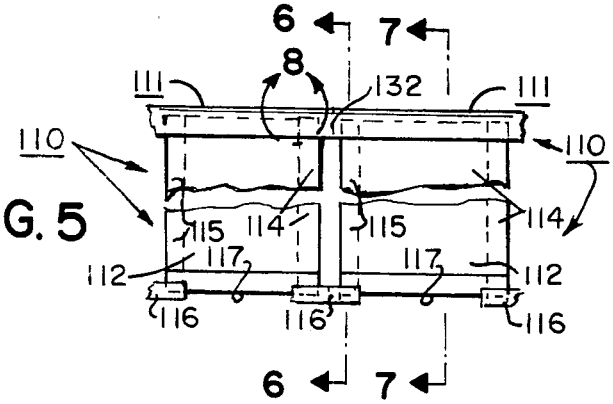
FIG. 5 is a plan view of an alternate form of the invention.
Figure 6:
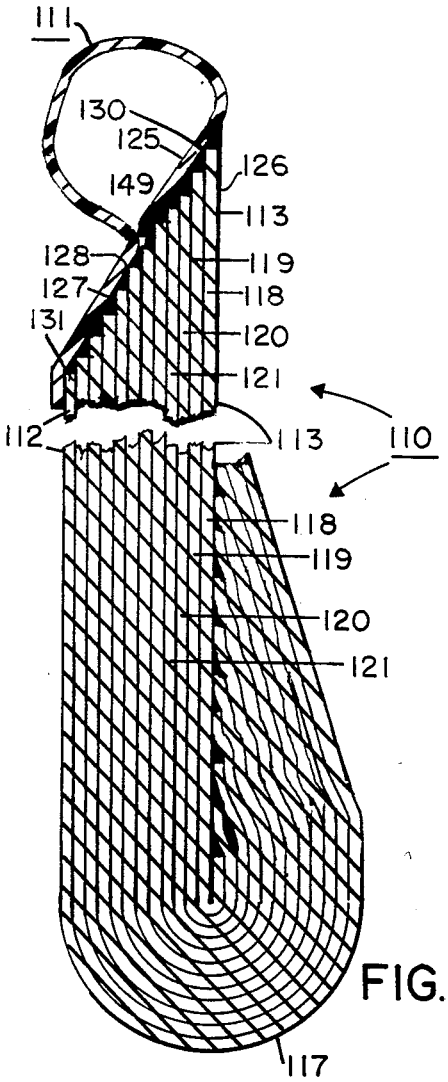
FIGS. 6 and 7 are enlarged sectional views along the lines 6—6 and 7—7 respectively of FIG. 5.
Figure 7:
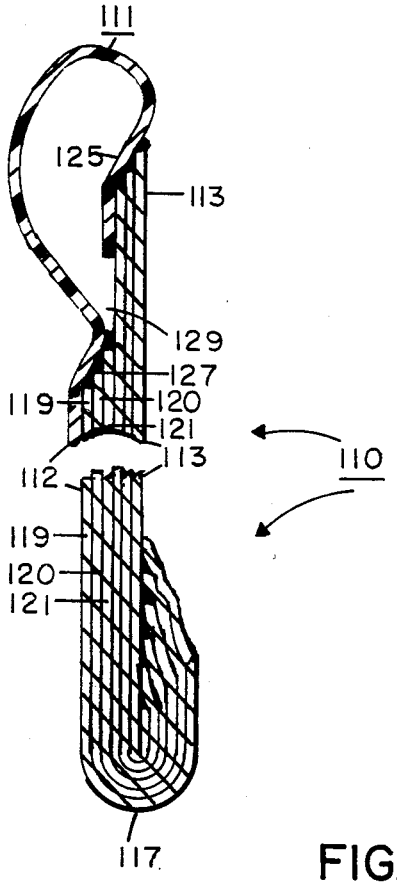

In FIG. 4, there is illustrated part of the top section of a completed bag after it has been filled, closed, and sealed. Top edge 26 of back wall 13 and top edge 28 of front wall 12 have been folded about a fold line 33 and one edge 25 and other edge 27 of strip means 11 have been activated. It is noted that the fold line 33 is within the top edge portion 28 of front wall 12 and/or within the other edge 27 of strip 11, such that other edge 27 of strip means 11 has also been folded upon itself and the entire other edge 27 forms the adhesive uniting the back wall to the front wall of the bag. The bag 10, primarily for appearance, may have the strip means 11 trimmed off after sealing, as shown in FIG. 4, or the strip means may be retained.

In the embodiment of FIGS. 5–8, the bag 110 is illustrated as being a multi-ply side gusseted bag having a front wall 112, a back wall 113, a fore gusset 114, and an aft gusset 115 with the fore and aft gussets 114 and 115 forming the side walls of the bag. In the chain of bags, the aft gusset 115 of the one bag is next adjacent the fore gusset 114 of the next succeeding bag and is spaced therefrom a preselected distance but held in alignment therewith by strip 111 and also by a bridge patch 116 interconnecting the bottom ends of the bag.

As further illustrated in the drawings, the front wall 112 and back wall 113, as well as the gussets, are formed from several plies 118, 119, 120, and 121 of bag material. The ends of the plies are stepped in the well known manner in the front and back walls and also in the front and back halves of the gussets. The bag 110 is an open mouth bag having its back wall 113 extending above the front wall 112 at the top end thereof and having its front wall folded over and adhered to its back wall at the bottom end 117 thereof.

The strip 111 is united along one edge 125 thereof to the top edge 126 of the back wall 113 and to the back half of each of the gussets 114 and 115 of each successive bag 110 in the chain of bags. The strip 111 is united along the other edge 127 thereof to the top edge 128 of front wall 112 and to the front half of each of the gussets 114 and 115 of each successive bag 110 in the chain of bags. The strip 111 is inverted U-shaped, elongated, and continuous such that it covers the open mouth 129 of bag 110 at the top end thereof. The one edge 125 of strip 111 is united to the inner surface 130 of the back wall 113 and to the edges and surfaces of the back halves of the gussets which will engage the outer surface 131 of the front wall 112. Also, the other edge 127 of strip 111 is united to the outer surface 131 of the front wall 112 and to the edges and surfaces of the front halves of the gussets which will engage the outer surface 131 of the front wall 112. The strip 111 may be of any preselected width so as to provide a tunnel of desired cross sectional dimension interconnecting the top ends of the bags in the chain of bags. Preferably the strip means is of such preselected width that it may be consumed between the front and back walls during and by the folding and the closing of the bag. It may be consumed by being activatable, e.g., by heat, to form the adhesive sealing the bag closed, as in the embodiment of FIGS. 1–4. It is noted one surface of strip 111 faces the back wall 113 and the other surface of strip 111 faces front wall 112. The one edge 125 and the other edge 127 of strip 111 may be united directly to each other as at 132 (FIG. 5) area in the space between the fore gusset 114 and aft gusset 115 and thus between the bags 110 next adjacent each other in the chain, to hold the gussets closed or in the collapsed condition.

In FIG. 8, there is illustrated part of the top end of a completed bag after it has been filled, closed, and sealed. Top edge 126 and top edge 128 have been folded about a fold line 133 and the one edge 125 and the other edge 127 have been activated. It is noted that the fold line 133 is within the top edge portion 128 of front wall 112 and/or within the other edge 127 of strip 111. Thus the other edge 127 has been folded back upon itself and the one edge 125 now overlies it. After activation the entire strip 111 may be disposed within the top end of the bag and primarily adhesively unites the back wall to the front wall in a sealed condition. The material from strip 111 fills all voids, cracks, and crevices between the plies in the gussets and front wall and the back wall of the bag.

A modification of the invention is illustrated in FIG. 9 in which the strip 211 is relatively flat. One surface of the strip on one edge 225 is adhered to the inside surface of the back wall 213, the gussets and the outer surface of the front wall 212. In this instance strip 211 seals the bag 210 until it is to be filled and may be slit or peeled partially therefrom to gain access to the mouth 229 of the bag. When the bag has been filled and the end folded and in the manner of FIG. 8, the strip serves in similar manner to that in the embodiment of FIGS. 5–8 to seal the bag.

Although this invention has been described in its preferred form with a certain degree of particularity, it is understood that the present disclosure or the preferred form has been made only by way of example and that numerous changes in the detail of construction and the combination and arrangement of parts may be resorted to without departing from the spirit and scope of the invention as hereinafter claimed.

What is claimed is:

1. In a chain of bags having front and back walls and top edges thereof defining mouths and with the bags interconnected along the mouths thereof by first and second elongated continuous strips separate from the bags themselves, the provision of:

means attaching one edge of said second strip to said top edge of said back wall of each successive bag and attaching one edge of said first strip to said top edge of said front wall of said successive bags;

each said bag having said back wall thereof extended beyond said front wall thereof at the mouth end thereof and being folded along a line parallel to said strips to lie adjacent said front wall and positioning at least a portion of said first strip between the inside surface of said back wall and the outside surface of said front wall; and at least said first strip being of activatable material such that said first strip adhesively and sealably unites said back wall to said front wall to closingly seal the respective bag.

2. The structure of claim 1 including each of said bags having the sides thereof gusseted, and the fold line within that top edge portion of the front wall and the said one edge of said first strip.

3. The structure of claim 1 including said one edge of said second strip being attached to the outer surface of said back wall.

4. The structure of claim 1 including said one edge of said second strip being attached to the inner surface of said back wall and thereby overlying and merging with said one edge of said first strip in the closed bag.

5. The structure of claim 1 including each of the bags having the sides thereof gusseted and said one edge of said first and second strips joined together between successive bags in the chain to hold the gussets collapsed at said mouth end of the bags.

6. The structure of claim 1 including bridging patches tying the bottom end of each bag to the bottom end of the next adjacent bags in the chain.

7. The structure of claim 1 wherein each end of said bag has a mouth thereof closed and interconnected by at least one strip.

8. A chain of bags, comprising, in combination:

first and second walls on each of said bags and a top edge on each of said walls;

at least one continuous strip of thermoplastic material having first and second edges;

said walls having a given composition and said at least one continuous strip being of material different from the composition of said walls;

means securing said first edge of said at least one strip to said top edge of said first wall and securing said second edge of said at least one strip to said top edge of said second wall for initial alignment means near the top of said chain of bags;

each of said bags having a mouth near the top of each bag;

each said bag being folded along a longitudinal line substantially parallel to said at least one continuous strip to trap said portion of at least one strip between the top edges of said first and second walls; and said portion of said at least one strip being activated to adhesively and sealably unite said first and second walls to closingly seal the mouth of the bag.

9. A chain of bags as set forth in claim 8, wherein said second wall has a length sufficient so that said top edge of said second wall initially extends beyond said top edge of said first wall; and each said bag second wall being folded over said first wall.

10. A chain of bags as set forth in claim 11, wherein each said bag is folded along a longitudinal line in the area of securement of said first edge of said at least one strip to the respective bag wall top edge so as to trap said portion of said at least one strip between the top edges of said walls.

11. A chain of bags as set forth in claim 10, wherein said securing means secures said second edge of said at least one strip to the outer surface of said top edge of said second wall.

12. A chain of bags as set forth in claim 8, including each said second wall having a length greater than that of said first wall at the top edges thereof; and said securing means securing said first edge of said at least one strip to the outer surface of said top edge of said first wall.

13. A chain of bags as set forth in claim 12 wherein said securing means secures said second edge of at said least one strip to the inner surface of said top edge of said second wall.

14. A chain of bags as set forth in claim 12, wherein said securing means secures the same surface of said at least one strip to said first and second wall top edges.

15. In a bag having first and second walls and top edges thereof defining a mouth, the provision of:

first and second elongated strips separate from said bag;

means attaching one edge of said first strip to said top edge of said first wall of the bag and attaching one edge of said second strip to said top edge of said second wall;

said bag having said second wall thereof extended beyond said first wall thereof at the mouth end thereof and being folded along a line parallel to said strips to lie adjacent said first wall, thereby positioning at least a portion of said first strip between the inside surface of said second wall and the outside surface of said first wall; and at least said first strip being of activatable material such that said portion of said first strip adhesively and sealably unites said first and second walls to closingly seal the bag.

16. In a chain of bags having first and second walls and top edges thereof defining mouths, the provision of:

first and second elongated strips separate from said bags;

means attaching one edge of said first strip to said top edge of said first wall of each successive bag and attaching one edge of said second strip to said top edge of said second wall of said successive bags;

each said bag having said second wall thereof extended beyond said first wall thereof at the mouth end thereof and being folded along a line parallel to said strips to lie adjacent said first wall, thereby positioning at least a portion of said first strip between the inside surface of said second wall and the outside surface of said first wall; and at least said first strip being of activatable material such that said portion of said first strip adhesively and sealably unites said first and second walls to closingly seal the respective bag.

* * * * *